US005435139A

United States Patent [19]

Pidcock et al.

[11] Patent Number: 5,435,139

[45] Date of Patent: Jul. 25, 1995

[54] REMOVABLE COMBUSTOR LINER FOR GAS TURBINE ENGINE COMBUSTOR

[75] Inventors: Anthony Pidcock; Stephen M. Cooper; Peter Fry, all of Derby, England

[73] Assignee: Rolls-Royce plc, London, England

[21] Appl. No.: 369,297

[22] Filed: Jan. 6, 1995

Related U.S. Application Data

[63] Continuation of Ser. No. 119,141, filed as PCT/GB92/00201, Feb. 3, 1992, abandoned.

[30] Foreign Application Priority Data

Mar. 22, 1991 [GB] United Kingdom ..... 9106085

[51] Int. Cl.[6] ..... F23R 3/06

[52] U.S. Cl. ..... 60/757; 60/752

[58] Field of Search ..... 60/752, 753, 754, 755, 60/757; 431/351, 352

[56] References Cited

U.S. PATENT DOCUMENTS

| | | | |
|---|---|---|---|
| 3,422,620 | 1/1969 | Fantozzi et al. | 60/755 |
| 4,071,194 | 1/1978 | Eckert et al. | 60/755 |
| 4,422,300 | 12/1983 | Dierberger et al. | 60/754 |
| 4,695,247 | 9/1987 | Enzaki et al. | 60/755 |
| 4,864,827 | 9/1989 | Richardson | 60/756 |
| 4,901,522 | 1/1990 | Commaret et al. | 60/752 |
| 4,912,922 | 4/1990 | Maclin | 60/757 |
| 5,000,005 | 3/1991 | Kwan et al. | 431/352 |
| 5,216,886 | 6/1993 | Ewing | 431/351 |

FOREIGN PATENT DOCUMENTS

| | | | |
|---|---|---|---|
| 0239020 | 9/1987 | European Pat. Off. . | |
| 0269824 | 6/1988 | European Pat. Off. . | |
| 488766 | 6/1992 | European Pat. Off. . | |
| 2333126 | 6/1977 | France . | |
| 2635577 | 2/1990 | France . | |
| 58072822 | 4/1983 | Japan . | |
| 0182034 | 10/1983 | Japan | 60/757 |
| 1093515 | 12/1967 | United Kingdom . | |
| 2073399 | 10/1981 | United Kingdom . | |
| 2087065 | 5/1982 | United Kingdom . | |
| 2204672 | 11/1988 | United Kingdom . | |

*Primary Examiner*—Timothy S. Thorpe

*Attorney, Agent, or Firm*—Cushman, Darby & Cushman

[57] ABSTRACT

A gas turbine engine combustor 20 has a wall structure 22 including an outer wall 24 having a plurality of wall elements 26 attached thereto. Each wall element 26 has a flange 27 around its periphery which defines a chamber 28 between each wall element and the outer wall 24. Holes 30 in the outer wall 24 permit the flow of cooing air into each chamber 28 to provide impingement cooling of the wall elements 26. Holes 30 in the wall elements 26 permit the exhaustion of cooling air from the chambers to provide film cooling of the wall elements 26.

9 Claims, 3 Drawing Sheets

REMOVABLE COMBUSTOR LINER FOR GAS TURBINE ENGINE COMBUSTOR

This is a continuation of application Ser. No. 119,141, filed as PCT/GB92/00201, Feb. 3, 1992, which was abandoned upon the filing hereof.

This invention relates to a gas turbine engine combustor and in particular to the construction of the wall of such a combustor.

The combustion process which takes place within the combustor of a gas turbine engine results in the combustor walls being exposed to extremely high temperatures. The alloys used in combustor wall construction are normally unable to withstand these temperatures without some form of cooling. Various combustor wall designs have been employed in the past which make use of pressurised air derived from the engine compressor for cooling purposes. In one particular wall design described in Great Britain Patent Application No 2,087,065A, the wall is made up of two parts: a continuous outer wall and an inner wall made up of a number of partially overlapping inner wall elements. The outer wall and inner wall elements are maintained in spaced apart relationship and cooling air is directed through holes in the outer wall into the space defined between them. The cooling air flows through the space to be exhausted through gaps defined between the overlapping portions of the inner wall elements. The cooling air thereby provides convection cooling as it flows between the inner wall elements and outer wall and film cooling of the inner wall elements after it has been exhausted from the gaps between inner wall elements.

It has been found with combustion chamber walls of this type that the film cooling of the inner wall elements is not as effective as would normally be desired. This can lead to overheating of and possible damage to the exposed edges of the overlapping portions of the inner wall elements.

It is an object of the present invention to provide a gas turbine engine combustor wall construction in which such film cooling is of improved effectiveness.

According to the present invention, a gas turbine engine annular combustor has a radially inner wall structure and a radially outer wall structure, each wall structure comprising a radially outer wall and a radially inner wall, said radially inner wall being constituted by a plurality of discreet wall elements, means being provided to maintain said wall elements and said radially outer wall in spaced apart relationship, said radially outer wall being apertured to permit the flow of cooling fluid into the spaces defined between said radially outer wall and said wall elements, each of said wall elements being apertured to facilitate the exhaustion of said cooling fluid from said spaces, means being provided to interconnect the periphery of each wall element and said outer wall said interconnection means defining a continuous wall around each wall element periphery which is integral with that periphery so that a discreet chamber is thereby defined between each of said wall elements and said radially outer wall for the flow therethrough of said cooling fluid.

The present invention will now be described, by way of example, with reference to the accompanying drawings.

Figure 1:
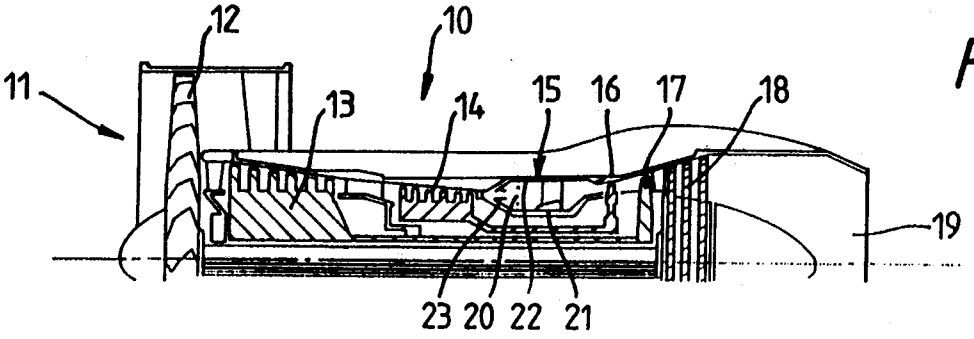
FIG. 1 is a sectional side view of the upper half of a ducted fan gas turbine engine which incorporates a combustor in accordance with the present invention.

With reference to FIG. 1 a ducted fan gas turbine engine generally indicated at 10 comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in the conventional manner so that air entering the intake 11 is accelerated by the fan 12 to produce two air flows: a first air flow into the intermediate pressure compressor 13 and a second airflow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16,17 and 18 before being exhausted through the nozzle 19 to provide additional propulsive thrust. The high, intermediate and low pressure turbines 16,17 and 18 respectively drive the high and intermediate pressure compressors 14 and 13 and the fan 12 by suitable interconnecting shafts.

The combustion equipment 15 is constituted by an annular combustor 20 having radially inner and outer wall structures 21 and 22 respectively. Fuel is directed into the combustor 20 through a number of fuel nozzles (not shown) located at the upstream end 23 of the combustor 20. The fuel nozzles are circumferentially spaced around the engine 10 and serve to spray fuel into air derived from the high pressure compressor 14. The resultant fuel/air mixture is them combusted within the combustor 20.

The combustion process which takes place within the combustion 20 naturally generates a large amount of heat. It is necessary therefore to arrange that the inner and outer wall structures 21 and 22 are capable of withstanding this heat while functioning in a normal manner.

Figure 2:
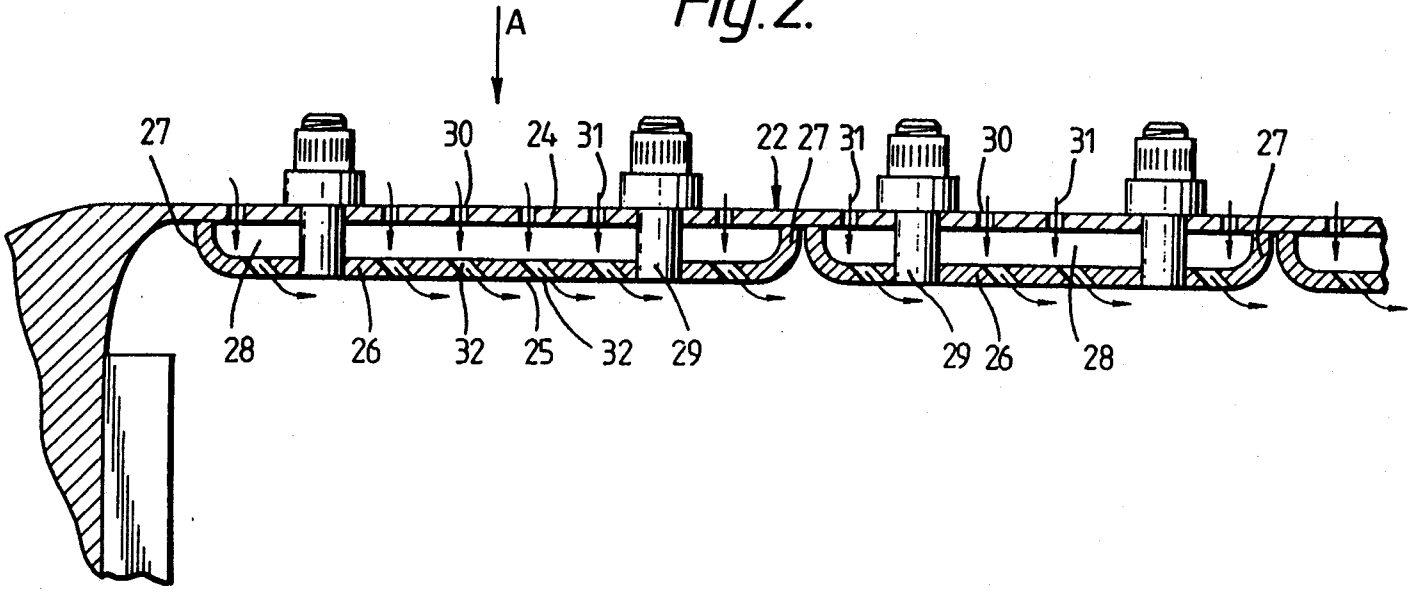
FIG. 2 is a sectional side view of a portion of the wall of the combustor of the gas turbine engine shown in FIG. 1.

The radially outer wall structure 22 can be seen more clearly if reference is now made to FIG. 2. It will be appreciated, however, that the radially inner wall structure 21 is of the same general configuration as the radially outer wall structure 22.

Referring to FIG. 2, the radially outer wall structure 22 comprises an outer wall 24 and an inner wall 25. The inner wall 25 is made up of a plurality of discreet wall elements 26 which are all of the same general rectangular configuration and are positioned adjacent each other. The majority of each wall element 26 is arranged to be equi-distant from the outer wall 24. However, the periphery of each wall element 26 is provided with a continuous flange 27 to facilitate the spacing apart of the wall element 26 and the outer wall 24. It will be seen therefore that a chamber 28 is thereby defined between each wall element 26 and the outer wall 24.

Each wall element 26 is of cast construction and is provided with integral bolts 29 which facilitate its attachment to the outer wall 24.

Figure 3:
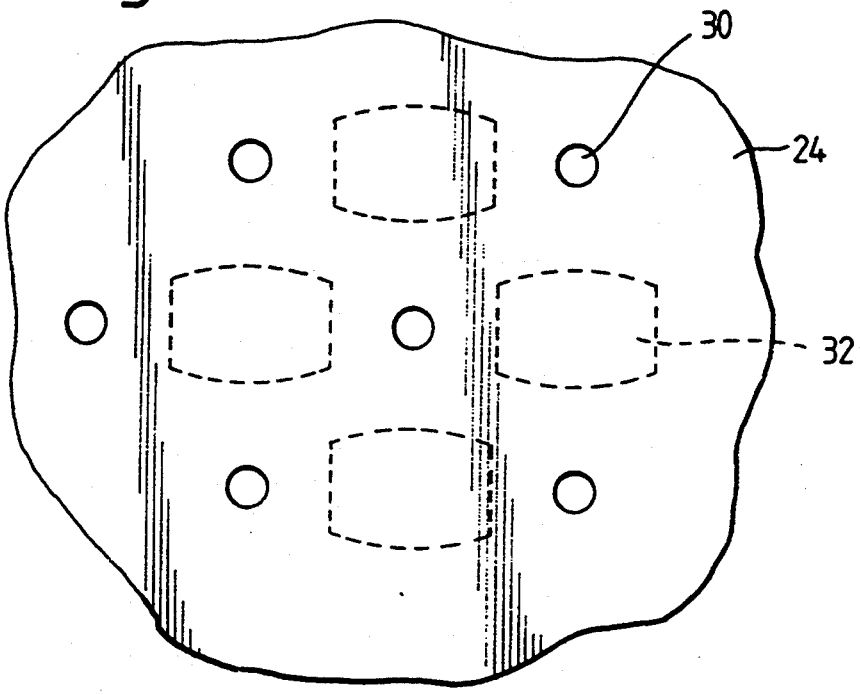
FIG. 3 is a view on arrow A of FIG. 2.

During engine operation, some of the air exhausted from the high pressure compressor 14 is permitted to flow over the exterior surfaces of the combustor 20. The air provides combustor 20 cooling and some of it is directed into the interior of the combustor 20 to assist in the combustion process. A large number of holes 30 are provided in the outer wall 24, which can also be seen in FIG. 3, to permit the flow of some of this air into the chambers 28. The air passing through the holes 30 impinges upon the radially outward surfaces of the wall elements 26 as indicated by the air flow indicating arrows 31. This ensures that each of the wall elements 26 is cooled in a highly effective manner. That air is then exhausted from the chambers 28 through a plurality of angled effusion holes 32 provided in each wall element 26. The effusion holes 32 are are so angled as to be aligned in a generally downstream direction with regard to the general fluid flow through the combustor 20.

Figure 4:
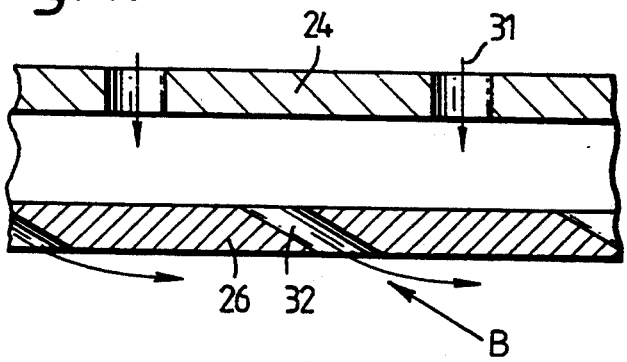
FIG. 4 is a view on an enlarged scale of a portion of the combustor wall shown in FIG. 2.
Figure 5:
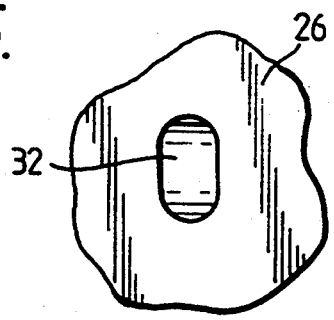
FIG. 5 is a view on arrow B of FIG. 4.

The angled effusion holes 32, which can be seen more clearly in FIGS. 4 and 5, are not of circular cross-sectional shape. Instead they are all of the so-called race-track configuration, that is, they have two parallel sides interconnected by semi-circular cross-section portions. This shape, together with the inclination of the hole 32, ensures that air exhausted from them forms a film of cooling air over the inward surface of each wall element 26, that is, the surface which confronts the combustion process which takes place within the combustor 20. This film of cooling air assists in protecting the wall elements 26 from the effects of the high temperature gases within the combustor 20.

It will be appreciated that although the present invention has been described with reference to effusion holes 32 which are of race-track cross-sectional configuration, other alternative configurations may also be effective in providing satisfactory wall element 26 cooling.

It will be seen therefore that each of the wall elements 26 is provided with two highly effective forms of cooling: impingement cooling and film cooling. They are therefore fully protected from the effects of the high temperatures within the combustor 20.

A further feature of the present invention is that none of the wall elements 26 presents exposed edges to the combustion process within the combustor 20. Consequently the overheating problems which may be experienced with wall elements having such exposed edges are avoided.

Figure 6:
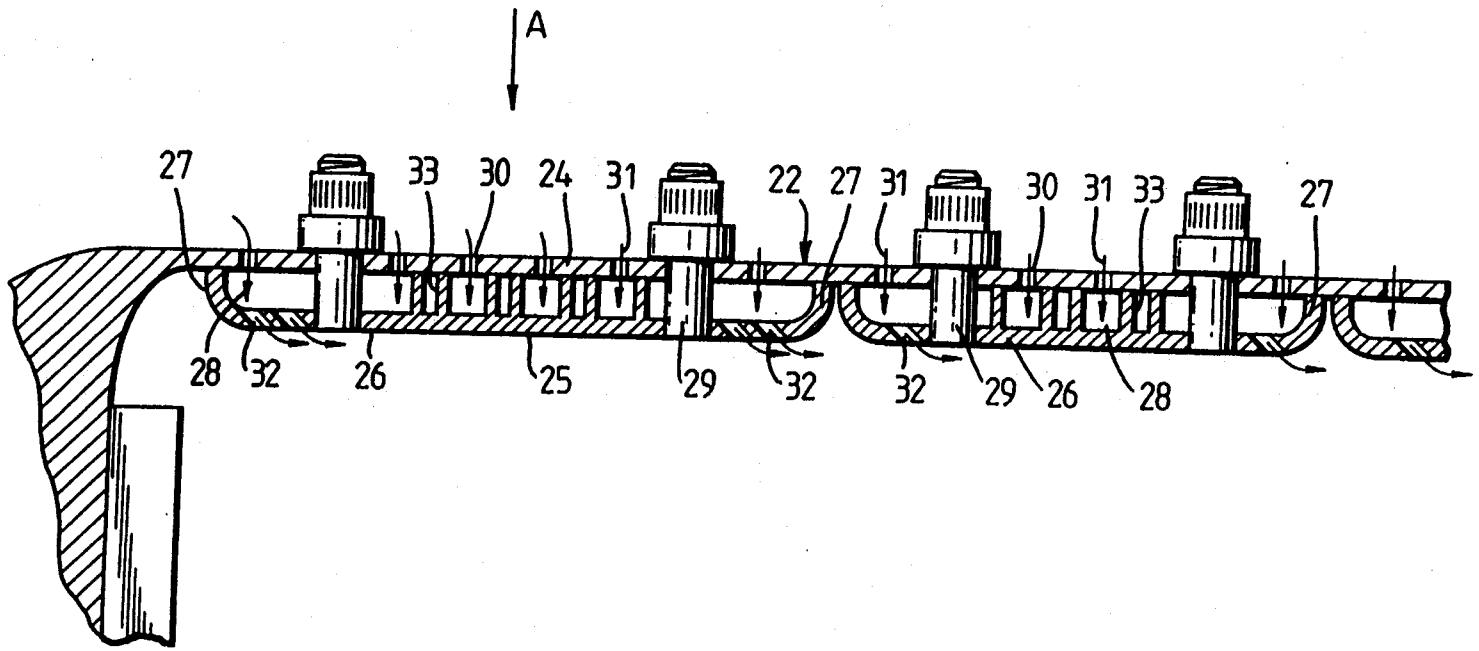
FIG. 6 is a view similar to FIG. 2 showing a modified form of combustor in accordance with the present invention.

It may be desirable in certain circumstances to enhance the heat exchange relationship between the cooling air passing through the chambers 28 and the wall elements 26. One way of readily achieving this would be to provide pedestals 33 or other suitable devices to increase surface area on the surfaces of the wall elements 26 which confront the outer wall 24 as can be seen in FIG. 6. The pedestals 33 are integral with the wall elements 26 and engage or terminate very close to the outer wall 24. The provision of the pedestals 33, which tend to be located in the central region of each wall element 26, results in a reduction in the number of the angled effusion holes 32 in each wall element 26. Consequently, the angled effusion holes 32 tend to be concentrated in the edge regions of the wall elements 26.

We claim:

1. A gas turbine engine annular combustor having an inner wall structure and an outer wall structure, each of said wall structures comprising an outer wall and an inner wall, said inner wall comprising a plurality or discreet wall elements covering at least portions of said inner wall, said discreet wall elements cooperating with removable bolts provided to removably maintain a majority of said wall elements and said outer wall in spaced apart relationship, each wall element being formed from a single piece of material and having a main portion and a periphery extending from said main portion, said periphery being in engagement with said outer wall to define with said outer wall a discreet chamber for the flow therethrough of a cooling fluid, said outer wall being apertured to permit the flow of a cooling fluid into the discreet chambers defined between said outer wall and said wall elements, each of said wall elements being apertured to facilitate the exhaustion of the cooling fluid from said chambers.

2. A gas turbine engine combustor as claimed in claim 1 characterised in that said apertures (30) in said outer wall (24) are so arranged as to direct cooling fluid on to said wall elements (26) to provide impingement cooling thereof.

3. A gas turbine engine combustor as claimed in claim 1 or claim 2 characterised in that said apertures (32) in each of said wall elements (25) are so arranged as to exhaust cooling fluid from said discreet chambers (28) to provide film cooling of said wall elements (25).

4. A gas turbine engine combustor as claimed in claim 3 wherein said combustor is arranged to have a general direction of fluid flow therethrough and said apertures in said wall elements are inclined in said general direction of fluid flow to facilitate said film cooling of said wall elements.

5. A gas turbine engine combustor as claimed in claim 4 characterised in that said apertures (32) in said wall elements (25) are of race-track cross-sectional configuration.

6. A gas turbine engine combustor as claimed in claim 1 characterised in that said wall elements (25) are positioned on said outer wall (24) so as to be generally adjacent each other.

7. A gas turbine engine combustor as claimed in claim 1 characterised in that each of said wall elements (25) is provided with integral bolts (29) to facilitate its attachment to said outer wall (24).

8. A gas turbine engine combustor as claimed in claim 1 characterised in that each of said wall elements (25) is provided with a plurality of pedestals (33) to enhance the heat exchange relationship between said wall elements (25) and said cooling fluid flow through said spaces (28) between said wall elements (25) and said outer wall (24).

9. A gas turbine engine combustor as claimed in claim 8 characterised in that each of said pedestals (33) engages said outer wall (24).

* * * * *